United States Patent [19]

Silver et al.

[11] Patent Number: 4,798,116

[45] Date of Patent: Jan. 17, 1989

[54] DOCUMENT SHREDDING MACHINE

[76] Inventors: Marc L. Silver, 1418 W. Princeton La., Schaumburg, Ill. 60193; John Pizzolato, 1017 Rene Ct., Park Ridge, Ill. 60068

[21] Appl. No.: 186,769

[22] Filed: Apr. 22, 1988

Related U.S. Application Data

[63] Continuation-in-part of Ser. No. 93,049, Sep. 4, 1987, abandoned.

[51] Int. Cl.[4] ..... B02C 19/12; B26D 1/03

[52] U.S. Cl. ..... 83/858; 241/168; 241/285 R; 241/289

[58] Field of Search ..... 30/114, 299, 304, 307; 83/858; 241/36, 100, 169, 169.1, 236, 95, 289, 32, 276, 239, 241, 290, 274, 285 R, 168, 225, 287, 288, 289, 290

[56] References Cited

U.S. PATENT DOCUMENTS

| | | | |
|---|---|---|---|
| 2,547,249 | 4/1951 | Bell | 30/304 X |
| 3,620,461 | 11/1971 | Pelleschi et al. | 241/100 |
| 4,485,977 | 12/1984 | Silverthorn et al. | 241/290 X |
| 4,564,146 | 1/1986 | Bleasdale | 241/236 |

*Primary Examiner*—Mark Rosenbaum
*Attorney, Agent, or Firm*—Douglas B. White

[57] ABSTRACT

There is provided a miniaturized document shredding device having engaging dual frictional conveyor rollers rotatably mounted within an enclosure. Fixed cutting blades are spaced across the width of the rollers and protrude through slits within the rollers to present cutting edges at the point of engagement of the rollers. In one embodiment these blades are mounted to the enclosure and protrude through the rollers, and in a second embodiment are mounted to the roller shafts between roller segments. With this arrangement, documents dropped through the top opening in the enclosure are picked up by the frictional rollers and conveyed by the rollers past the cutting blades to produce a shredded product.

17 Claims, 3 Drawing Sheets

DOCUMENT SHREDDING MACHINE

This application is a continuation-in-part of co-pending U.S. patent application Ser. No. 093,049, filed Sept. 4, 1987, now abandoned.

BACKGROUND OF THE INVENTION

1. Field of the Invention

This invention relates generally to improvements in document shredding machines and the cutter assemblies used therewith. More particularly, this invention relates to miniaturized energy efficient document shredding apparatus for handling light duty shredding tasks.

2. Description of the Prior Art

Generally in the art there have been developed document shredding machine arranged to receive documents fed into a cutter assembly; and therein cut, chop and shred the documents using opposing high speed cutting wheels. One of the earliest of such machines is represented by the U.S. Pat. No. 1,178,386 issued to Edwards in 1916. In his device there is described opposing cutting wheels having blades protruding on the periphery, thereof. These are arranged to intermesh while rotating at high speed and thereby cut documents dropped therebetween. Since that basic design, the opposing cutting wheels have been in general use. The U.S. Pat. No. 1,319,496 issued to Stachowski in 1919 describes an improvement on the Edwards dual rotating cutters by adding means to strip the cut material from the intermeshing cutting wheels. This prevents jamming and feeds the material into a waste chute.

Advance in this art has been quite slow and is exemplified by the 1940 improvement patent (U.S. Pat. No. 2,202,843) issued again to Edwards. He improved the mounting of the rotating cutters, improved the strippers and added a feed chute. Thereafter, and it wasn't until approximately ten years later, in 1951, that another improvement (U.S. Pat. No. 2,554,114) proposed modified stationary combers fitting within the rotating knife blades of the old dual roller blade system. This kept the blades clear of debris and further prevented malfunction.

Since those old designs were completed there was very little activity until recently. The U.S. Pat. No. 4,018,392 issued to Wagner proposed an improved mounting for the dual rotating cutters and again another improvement in the combing mechanism. In 1981, another improvement to the cutter mechanism was proposed by Hatanaka in U.S. Pat. No. 4,260,115 which provided a dramatic change in the appearance of the shredded product. This confetti cut is obtained with a combination of the dual rotating blades against horizontal stationary spacers to provide the cross cut. This design represented an improvement of a transverse cutting system patented in 1971 (U.S. Pat. No. 3,620,461) which required separate cutting operations for the longitudinal and transverse cutting.

More recent improvements have dealt with anti-clogging and anti-jamming mechanisms. In U.S. Pat. No. 4,330,092 there is provided means for adjusting the overlap between the two cutter blade assemblies to help prevent clogging. Similarily, in the U.S. Pat. No. 4,411,391 issued to Crane, an improvement is described where one of the cutting rollers is movable so that thick or uncuttable material will pass through the dual rotating cutting rollers instead of jamming the machine. A contrary position was taken by General Binding Corporation in its U.S. Pat. No. 4,489,897 where there is provided mounting yolks arranged to straddle the cutting blades and further support the cutting rollers. This prevents their separation regardless of the material passing therebetween.

No system heretofore proposed provides a compact energy efficient means for shredding paper which is adaptable to miniaturization. All systems proposed to date utilize high speed rotating roller mounted blades with means for frictionally scrubbing or combing the shredded paper therefrom. Typically, these have been driven through a gear or belt drive from an electrical motor, and in some cases employed a belt conveyor to feed the material to the rotating cutter blades. These designs have proved to be energy inefficient and prone to jamming and malfunction.

Accordingly it is a principal object of the present invention to provide a compact document shredding device which is extremely energy efficient and economical to manufacture.

It is another object of the present invention to provide a document shredding device which has few moving parts, low rotational inertia, and which is not prone to clogging or jamming.

It is yet another object of this invention to provide a document shredding device which may be miniaturized, hand held, and battery powered.

It is similarly an object of this invention, in a further embodiment, to provide a shredding mechanism having rollers which are yielding to allow objects to pass therethrough.

It is still a further object to provide a document shredding device which is operable at slow and safe speeds without the danger of exposed moving blades.

It is yet a further object of this invention to provide an apparatus which combines the cutting mechanism with the document conveyor mechanism to positively feed the paper through the cutter.

It is finally an object of this invention to provide apparatus which exhibits an easily replaceable cutting head in a safe cartridge form.

SUMMARY OF THE INVENTION

Generally there is provided a miniaturized, compact document shredding device having dual frictional rollers rotatably mounted therein and arranged to mate one against the other. Cutting blades in one embodiment are fixed to the enclosure and spaced across the width of the shredding device, protruding through slits within the rollers. In a second embodiment, the blades are mounted to the roller axles on bushings between roller segments. With this arrangement, documents dropped into the top are directed to the frictional rollers where they are picked up and conveyed by the rollers to the point of engagement or tangent therebetween. There the documents are pinched and forced by the rollers against, onto and past the cutting blades to produce a shredded product. A reversible battery operated motor is provided to drive the rollers, and any obstruction is therefore quickly removed by simple switch reversal.

While the invention will be described in connection with a preferred embodiment, it will be understood that we do not intend to limit the invention to that embodiment. On the contrary, we intend to cover all alternatives, modifications, and equivalents as may be included within the spirit and scope of the invention as defined by the appended claims.

DESCRIPTION OF THE PREFERRED EMBODIMENT

Figure 1:
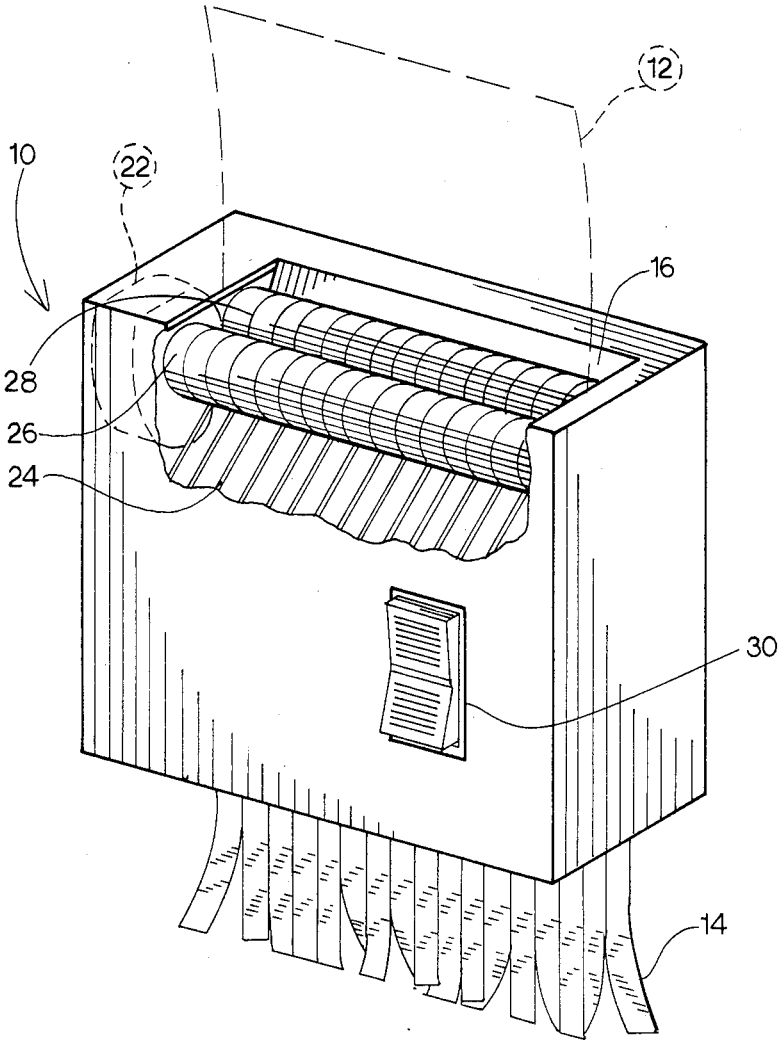
FIG. 1 depicts a perspective view of the document shredding device of the present invention showing paper, in phantom, being fed between frictional rollers where it is caught and conveyed past a cutting mechanism and thereby shredded.

Turning first to FIG. 1 there is shown a perspective view of the document shredding device of the present invention. An enclosure 10 is arranged to receive paper 12 fed therethrough and generate at its lower end a shredded product 14. The documents are fed past a lip 16 arranged to position the paper onto the rollers and prevent misfeed behind the rollers. Paper fed past the lip drops into contact with roller members 18 and 20 turning one against the other (see FIG. 2), each exhibiting a frictional surface thereon.

In one embodiment there is provided an actively driven roller 18 and a passive roller 20 driven off of the positively driven roller 18. For driving the roller 18 there is provided, in one embodiment, an electric motor 22 having its armature directly connected without linkage or mechanical conversion to the frictional roller 18. Together the frictional rollers provide a conveying chute arranged to grab the incoming paper and feed it past the angled cutting blades 24. These blades are spaced across the enclosure and mounted thereto. When passed through the vicinity of the rollers the blades are arranged to protrude through paired slits 28 spaced across the rollers. These slits divide the frictional rollers into segments 26 for frictionally holding the paper between the blades.

In alternate embodiments, the drive roller may be driven at both ends by dual motors. This would increase the power available for shredding tougher material. Similiarly, the rollers may both be driven by separate drives to further increase the power to the shredding mechanism, with the contact between the rollers synchronizing their motion.

For operating the electric motor there is provided a rocker switch 30. This switch is arranged to provide the electric motor 22 with one polarity of current to drive it in a first direction when the rocker switch is pressed in a first direction. Similarly, the rocker switch changes the polarity to the electric motor to drive the electric motor in a second direction when the rocker switch is switched to its second position.

Figure 2:
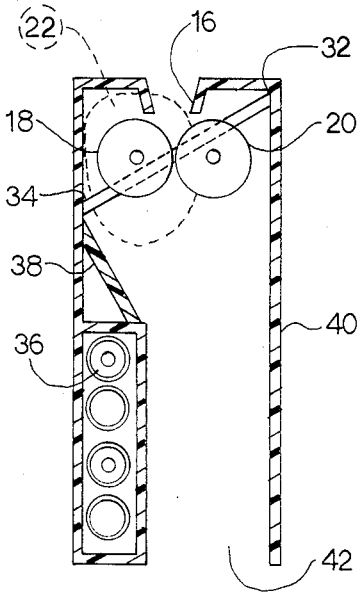
FIG. 2 is a cross sectional view of the document shredding device of FIG. 1 showing in particularity the positioning of an incoming paper guide, the roller cutting mechanism and the battery compartment.

Turning now to the cross section shown in detail in FIG. 2, the roller conveyors 18 and 20 are depicted mounted proximate and below an incoming chute 16 and arranged to pick up paper dropped therebetween. Moreover, the cutting blades are fixedly mounted in an angularly manner between the upper portion 32 of the enclosure and a lower point 34 on the opposing side of the enclosure. These blades are positioned near the point of engagement or tangent of the rollers so as to slice paper after it is pinched and held between the rollers. In an alternative embodiment, shorter blades are cantilevered from the upper mounting and thereby are spring loaded into position. With this mounting, the blades will flex to allow hard uncut material to pass without causing a machine jam.

Within the enclosure, in a compartment provided therefor, battery power for energizing the motor is obtained through a plurality of batteries 36. These are positioned along one side of the enclosure and electrically connected to the rocker switch 30 and the drive motor 22, to provide selective reverse polarity switching. The lower portion of the enclosure is arranged to form an outgoing chute between ramp 38 and the opposing side 40 of the enclosure to allow the shredded paper to exit through the lower opening 42.

Figure 3:
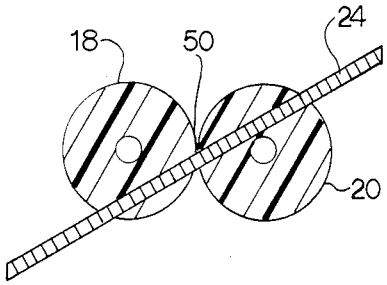
FIG. 3 is an accurate geometric construction of one embodiment of the roller conveyor aspect of the present invention, enlarged and removed, showing the positioning of the cutter blades.

A geometric construction of the operative elements of one embodiment of the conveyor and cutting system of the present invention is depicted in FIG. 3. The conveyor rollers 18 and 20 are shown touching and engaging at a tangent point 50. In this embodiment these rollers are of a smooth frictional material functioning to seize and convey the paper to and through the tangent point 50. In an alternative embodiment the surface of each roller is of an extreme roughened nature to securely grasp the various types of paper. The angle formed by the combined surfaces of the two rollers forms a feed chute to assist the paper to come into contact with the rollers and the narrowed tangent point. Proximate this tangent point and, preferably just slightly below, there is provided the cutting blades 24 arranged to cut the paper forcefully fed past the tangent point, just as it passes the tangent point.

In still a further embodiment of the invention there is provided a low inertia design of the rollers wherein the center of the roller segments 26 are hollowed. This allows for minimal power drain during operation and faster response when switched on.

Finally, jamming of the shredding device is further prevented in this mechanism by the use of rollers having a surface thereof which is yielding and deformable. While it seizes paper during normal operation, the yielding surface accomodates hard objects which may be inadvertently fed therethrough. Similarly, one of the rollers may be slideably mounted in order to shift under pressure of an entrapped object. When used in conjunction with the pivotal blade mounting discussed above, this shredding mechanism cannot normally be caused to jam.

Figure 4:
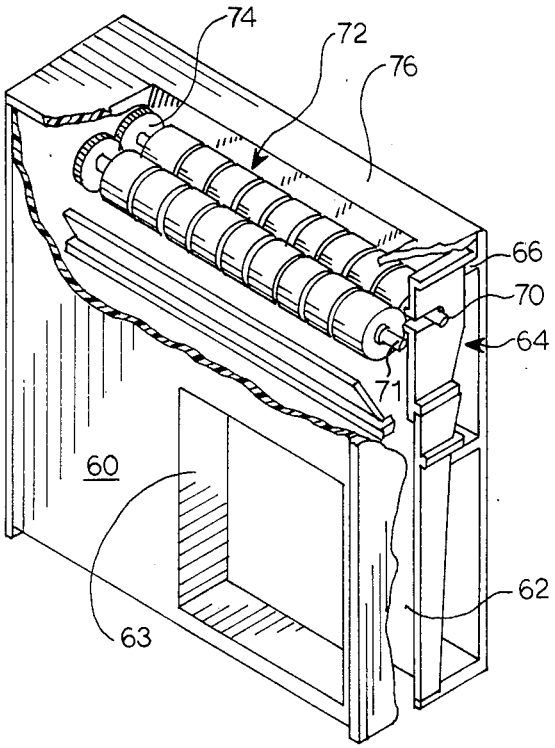
FIG. 4 depicts a perspective view, partially cut away, of a second embodiment of the roller/cutter assembly arranged as a cartridge insert for the apparatus.
Figure 5:
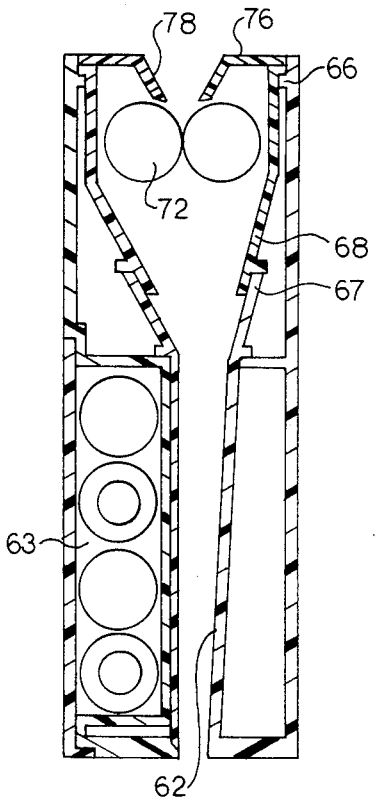
FIG. 5 is a cross sectional view of the document shredding device of FIG. 4 showing the nesting of the roller/cutter cartridge.

An alternate embodiment of the roller/blade apparatus, particularly adapted to function as a cartridge insert is depicted in perspective in FIG. 4 and in cross section in FIG. 5. The outer case 60 is arranged to enclose an outgoing chute 62, a battery compartment 63, and to nest the cartridge 64 therein. This nesting of the cartridge 64 within the enclosure is most clearly shown in the cross section of FIG. 5. The cartridge 64 is arranged to be supported by and nest within the upper and lower supports 66 and 67 respectively of the outer case 60. These supports are represented by ledges defined on the periphery of the interior of the enclosure and positioned to mate with corresponding lips of the cartridge when it is dropped into place.

The cartridge is comprised of a housing 68 having shaft support openings 70 for supporting the shafts 71 of the rollers 72. As before, these rollers exhibit drive engagement means 74, such as gears, on one end thereof for receiving power transmission. Power drive may be applied to one or both rollers by direct or transmitted means. When applied to one roller, the driven roller is arranged to drive the other opposing roller.

The top 76 for the enclosure is provided with a longitudinal opening as in the earlier embodiment for insertion of documents and downward protruding faces 78 of the top 76 serve to form a chute to the rollers to direct the paper thereto in the manner described with the earlier embodiment. The top 76 is arranged to lock into place at the upper extremity of the outer case 60 to hold the cartridge in place against its supports. This lock is of a type well known in the art of plastic enclosures and perferably is of a snap-in friction fit. The snap-in lock of the top of the enclosure functions with the cartridge cutter mechanism to provide easy replacement of blades that may be dulled through use. Upon opening of the top, when the mechanism is inverted the cartridge is free to be removed from the case and the concealed blades of the cartridge yield a device which is safe to handle.

Figure 6:
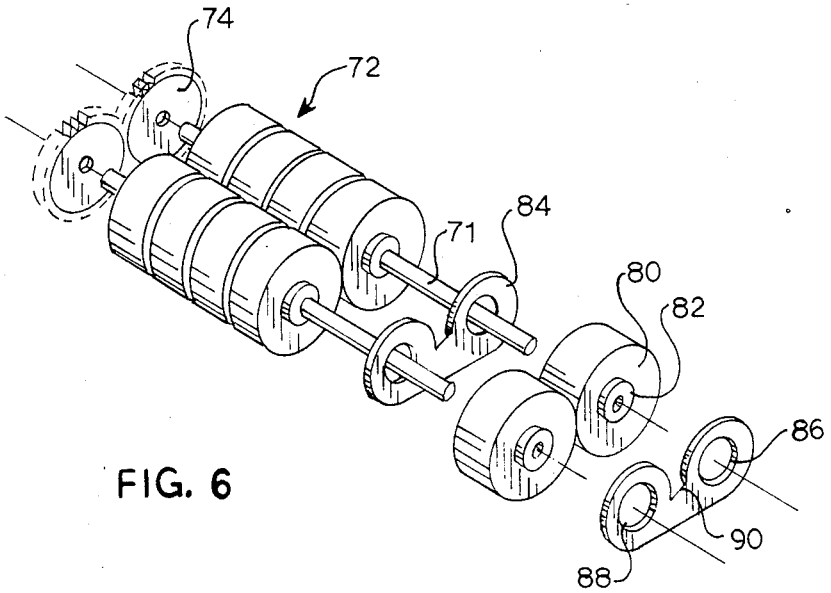
FIG. 6 is a perspective view of the segmented rollers and cutting blade assembly of FIG. 4.
Figure 7:
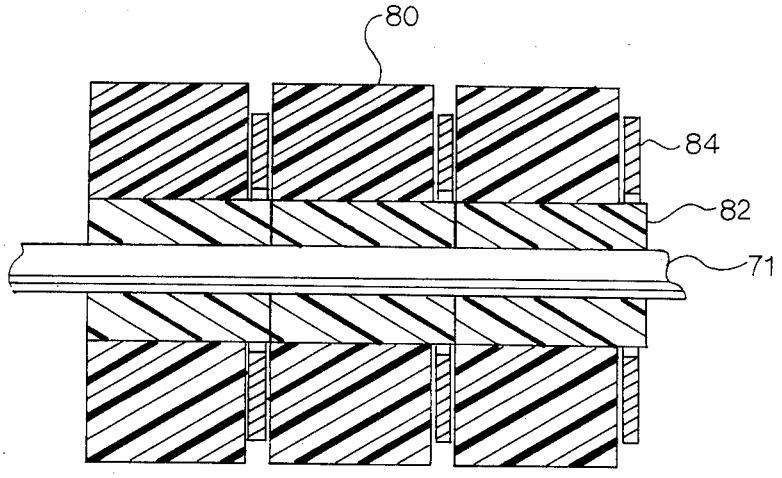
FIG. 7 is a cross sectional view of the segmented rollers and cutting blade assembly of FIG. 6.

The assembly of the rollers and cutting blades of this alternate embodiment are shown most clearly in a partially exploded view in FIG. 6 and in cross section in FIG. 7. Roller segments 80 are mounted on bushings 82 secured to the shafts 71 for rotation therewith. An anti-friction outer surface of the these bushings presents a mounting upon which the blades 84 are supported. Cylindrical openings 86 and 88 of the blade members 84 are positioned to align on and be supported by the bushings.

Figure 8:
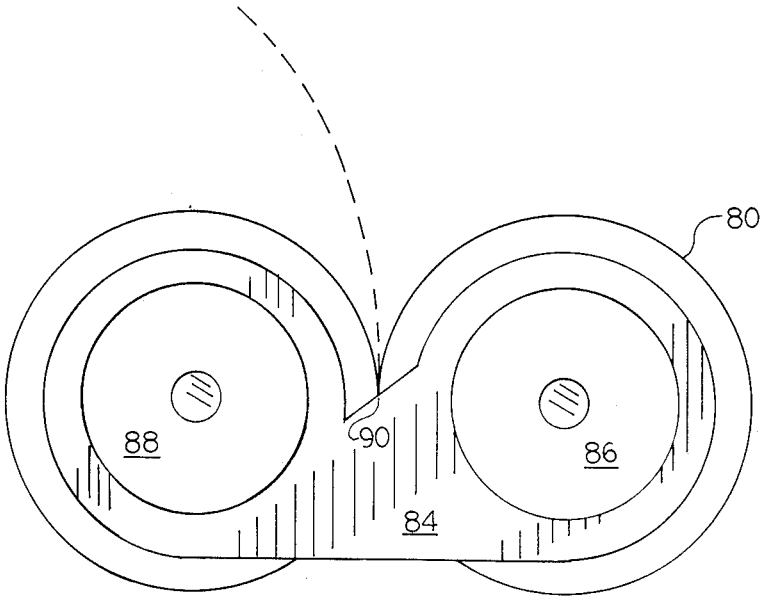
FIG. 8 is a geometrical construction of the rollers and blades of FIG. 7 as viewed from the end, showing the relation of the blades to the rollers.

Turning to FIG. 8 the relationship of the blades and the roller feed mechanism is most clearly understood. Between the cylindrical mounting openings of the blade members and arranged to span the tangent between the rollers there is provided an angled blade portion 90. This blade portion is sharpened and mounted to present a cutting edge proximate the tangent to the rollers, while at all times the blade is concealed for safety. Paper fed through the top chute is directed to the device between the rollers where it is pinched and held while it is forced past the blade edge 90.

In an alternate version, the blades may be mounted to a roller shaft on one side only, and spring controlled to hold it into position. Accordingly, this blade mounting will yield when hard objects are fed through the roller mechanism to prevent jamming.

From the foregoing description, it will be apparent that modifications can be made to the apparatus and method for using same without departing from the teaching of the present invention. Accordingly, the scope of the invention is only to be limited as necessitated by the accompanying claims.

We claim:

1. A document shredding machine comprising:
a frame member;
first and second engaging conveyor rollers rotatively mounted to said frame member and having a plurality of paired transverse slits defined therein;
means for driving said rollers; and
cutting means fixed to said frame member and protruding through said slits in said rollers and arranged to present a cutting edge proximate the point of engagement of said rollers, whereby documents are conveyed by said rollers past said cutting means to cause shredding.

2. The document shredding machine of claim 1 wherein said first conveyor roller is rotated by drive means, and said second conveyor roller is driven by said first conveyor roller.

3. The shredding machine of claim 2 wherein said first conveyor roller is directly driven by an electric motor axially mounted therewith.

4. The shredding device of claim 3 wherein said electric motor is selectively reversible to thereby free objects jammed in the cutting mechanism.

5. The document shredding machine of claim 1 wherein said rollers exhibit a frictional surface.

6. The document shredding machine of claim 1 wherein said rollers are comprised of a low inertia design.

7. The document shredding machine of claim 1 wherein said frame member is comprised of an enclosure member having an elongated opening therein for feeding documents to said conveyor rollers.

8. The document shredding machine of claim 7 further comprising a feed chute extending from said elongated opening toward said conveyor rollers.

9. The shredding machine of claim 1 wherein said rollers exhibit a yielding surface, and wherein said cutting means comprises pivotally mounted cutting blades, whereby objects may be passed through the cutting mechanism.

10. The shredding machine of claim 1 wherein one of said conveyor rollers is slideably mounted, and wherein said cutting means comprises pivotally mounted cutting blades, whereby objects may be passed through the cutting mechanism.

11. A document shredding machine comprising:
a frame member;
first and second engaging conveyor rollers rotatively mounted to said frame member, said rollers comprising a shaft and a plurality of spaced cylindrical segments mounted on said shaft for rotation therewith;
means for driving said rollers; and
cutting blades mounted on said roller shafts between said segments and arranged to extend between said rollers to thereby present cutting edges proximate the point of engagement of said rollers, whereby documents are conveyed by said rollers past said cutting blades to cause shredding.

12. The document shredding machine of claim 11 wherein said first conveyor roller is rotated by drive means, and said second conveyor roller is driven by said first conveyor roller.

13. The shredding machine of claim 12 wherein said first conveyor roller is directly driven by an electric motor axially mounted therewith.

14. The document shredding machine of claim 11 wherein said rollers exhibit a frictional surface.

15. The document shredding machine of claim 11 wherein said rollers are comprised of a low inertia design.

16. The document shredding machine of claim 11 wherein said frame member comprises a cartridge arranged to fit within an enclosure.

17. The document shredding machine of claim 16 further comprising a feed chute defined in said enclosure arranged to extend toward said conveyor rollers.

* * * * *